US005720364A

United States Patent [19]

Glover

[11] Patent Number: 5,720,364

[45] Date of Patent: Feb. 24, 1998

[54] STAIRLIFT LEVELLING ARRANGEMENT

[75] Inventor: Douglas William Glover, Andover, United Kingdom

[73] Assignee: Stannah Stairlifts Limited, Hampshire, United Kingdom

[21] Appl. No.: 656,259

[22] PCT Filed: Jan. 5, 1995

[86] PCT No.: PCT/GB95/00012

§ 371 Date: May 28, 1996

§ 102(e) Date: May 28, 1996

[87] PCT Pub. No.: WO95/18763

PCT Pub. Date: Jul. 13, 1995

[30] Foreign Application Priority Data

Jan. 5, 1994 [GB] United Kingdom ..... 9400056

[51] Int. Cl.[6] ..... B66B 9/08

[52] U.S. Cl. ..... 187/201; 187/245

[58] Field of Search ..... 187/201, 200, 187/245; 182/2, 12

[56] References Cited

U.S. PATENT DOCUMENTS 4,811,226 3/1989 Shinohara ..... 364/424.05
5,230,405 7/1993 Bartelt ..... 187/12

FOREIGN PATENT DOCUMENTS 2168019 6/1986 United Kingdom .
0560433 9/1993 United Kingdom .

*Primary Examiner*—Kenneth Noland
*Attorney, Agent, or Firm*—Edwin D. Schindler

[57] ABSTRACT

A stairlift comprises a carriage for movement along a fixed rail the angle of inclination of which varies along its length. A seat is pivotally mounted to the carriage and an actuating device is used for turning the seat relative to the carriage. A control device of the stairlift responds to the position of the carriage along its rail and the stored data representing the desired angle between the seat and carriage at different positions along the rail, to control the actuating device so as to maintain the seat substantially level as the carriage moves along the rail.

7 Claims, 2 Drawing Sheets

STAIRLIFT LEVELLING ARRANGEMENT

This invention relates to stairlifts and more particularly to an arrangement for maintaining the seat of a stairlift level as its carriage moves along a rail of varying angle of inclination.

In some stairlift installations, the rail is able to maintain a constant angle of inclination: in these cases, the seat remains at a constant angle relative to the carriage of the stairlift. Often however, the stairs do not rise at a constant rate, for example where the stairs include a landing: in these cases it is necessary for the angle of the seat, relative to at least part of its carriage, to be changed as the carriage moves along the rail, so as to keep the seat level. Hitherto, this has been achieved mechanically, the seat being pivotally mounted to the carriage and coupled to a lever which follows a guide bar fixed to the main rail of the stairlift: the location of the guide bar on the rail controls the angle of the lever and accordingly the angle of the seat. The location of the guide bar on the rail, at different positions along its length, is therefore critical to ensure that the seat will remain level, and therefore the rail and its guide bar must be tailored to each individual installation.

We have now devised an arrangement which overcomes the problem which has been set out above.

In accordance with this invention, there is provided a stairlift comprising a carriage for movement along a fixed rail, a seat pivotally mounted to the carriage, an actuating means for turning the seat relative to its carriage, and control means responsive to the position of the carriage along its rail and to stored data representing the desired angle between the seat and carriage at different positions of the carriage along the rail, to control the actuating means so as to maintain the seat substantially level.

Preferably the actuating means for turning the seat relative to its carriage comprises an electric motor. Preferably this motor is included in a closed-loop servo control.

Preferably the control means determines the linear position of the carriage along its rail from a count related to the turns made by a drive motor of the carriage: typically this motor drives a pinion wheel meshed with a toothed rack provided along the rail.

Preferably the control means is arranged to make linear interpolations between successive items of the stored data, to provide an uninterrupted demand signal to the seat levelling motor.

Preferably a safety arrangement is provided, which responds to the seat tilting, relative to the carriage, to more than a predetermined angle, to lock the seat to the carriage. The arrangement may comprise a pin which is spring-biassed to extend through a locating aperture of the seat, but is normally held retracted by a solenoid the circuit to which includes a pair of opposite tilt switches.

Preferably a controller is provided, for preprogramming the control means of the stairlift with its data representing the desired seat-to-carriage angle at different linear positions of the carriage along its rail. In use of this controller, the carriage is moved to successive points along the rail and, at each point, the seat is levelled via the controller and then the corresponding linear position and seat-to-carriage angle are written into memory.

Alternatively or in addition, the control means may include an auto-calibration facility, including means to self-level the seat at successive points along the rail, and then write the corresponding linear position and seat-to-carriage angle into memory.

An embodiment of this invention will now be described by way of example only and with reference to the accompanying drawings, in which.

Figure 1:
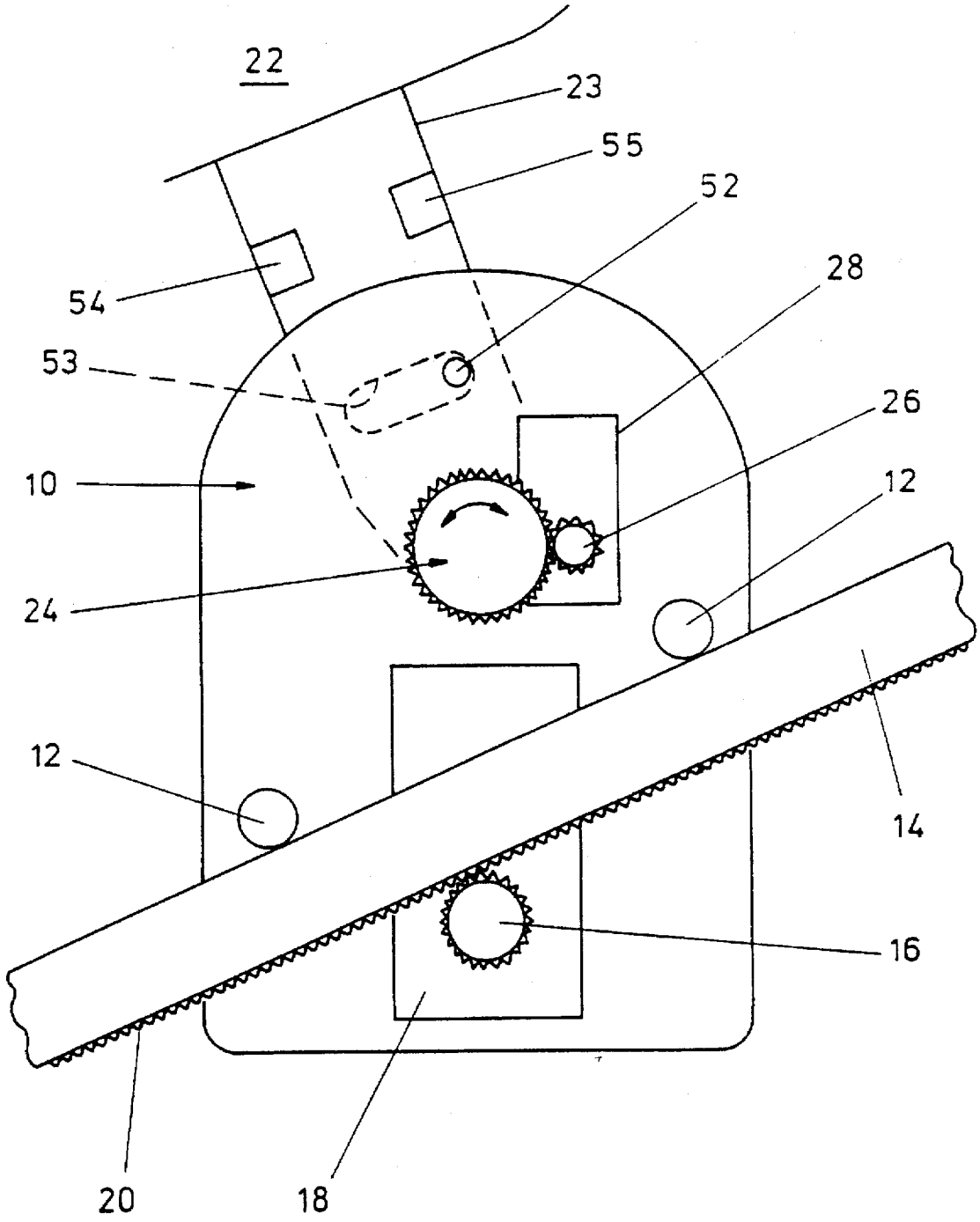
FIG. 1 is a diagrammatic side view of the carriage of a stairlift mounted to its fixed rail.

Referring to FIG. 1, there is shown a stairlift comprising a carriage 10 having wheels 12 enabling it to run on a fixed rail 14 installed on a stairway. The carriage includes a drive motor which drives a toothed pinion wheel 16 via a reduction gearbox: the drive motor and its gearbox are indicated at 18. The pinion wheel 16 meshes with a toothed rack 20 formed on the rail: thus energisation of the drive motor, in forwards or reverse directions, produces movement of the carriage along the rail, respectively up or down the stairs. A seat, indicated at 22, is pivotally mounted to the carriage via a support 23 and a horizontal shaft 24, and the carriage further includes a motor which drives a shaft 26 via a gearbox: this motor and its gearbox are indicated at 28, and the two shafts 24 and 26 carry toothed pinion wheels which are meshed with each other as shown. Thus energisation of this motor, in one direction or the other, changes the angle of the seat relative to its carriage, respectively in one sense or the other.

Figure 2:
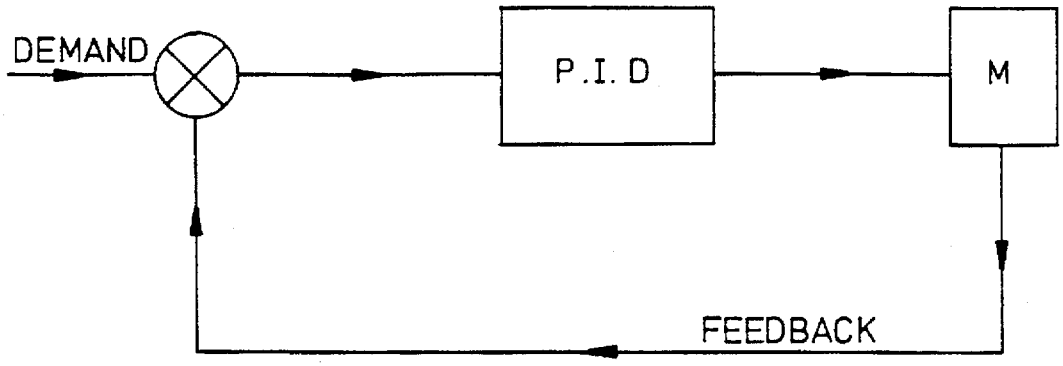
FIG. 2 is a diagram of a closed-loop servo control for a seat levelling motor of the stairlift.

As shown in FIG. 2, the seat levelling motor M is included in a closed-loop servo control system, preferably a conventional proportional/integral/differential control system, which uses a feedback signal representing the actual angular position of the seat relative to the carriage: this feedback signal may be derived from a potentiometer or other transducer coupled to the rotary seat mounting shaft 24. The seat angle demand signal is derived from a look-up table or map which gives desired angles for different linear positions of the carriage along its rail 14: the actual position of the carriage may be determined, for example by counting the number of turns of the drive motor 18 or the pinion wheel 16. The control system microprocessor makes linear interpolations between successive calibration points of the look-up-table, to ensure continuity of the seat angle demand signal.

In operation, a person sitting on the seat of the stairlift will depress one push-button to energise the drive-motor in one direction to drive the carriage up the stairs, or a second push-button to energise the drive motor in its opposite direction to drive the carriage down the stairs. The control system provides a demand signal for the levelling motor, according to the position of the carriage 10 along the rail 14, to control the angle of the seat relative to the carriage: as the carriage 10 changes its orientation, due to changes in the angle of the inclination of the rail 14 at different points along its length, the servo-control system changes the angle of the seat 22 relative to the carriage 10, so as to maintain the seat 22 level.

Figure 3:
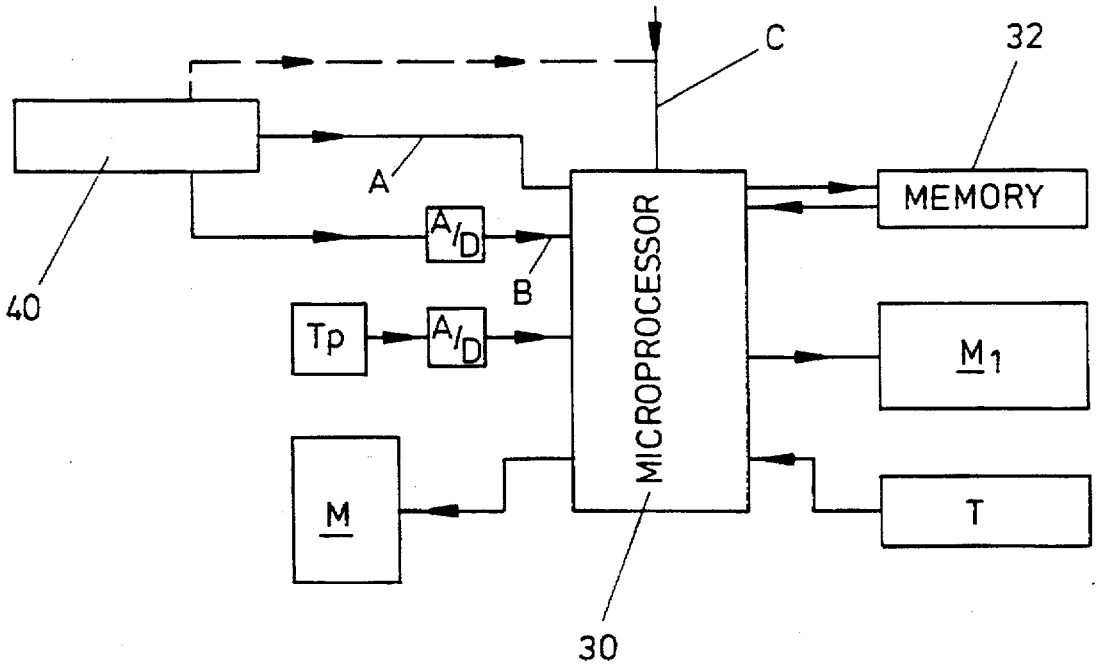
FIG. 3 is a schematic diagram of a control system of the stairlift, including a preprogramming controller for the linear position and seat-to-carriage angle data.

The control system is shown schematically in FIG. 3, together with an arrangement for preprogramming the look-up-table. Thus, FIG. 3 shows the system microprocessor 30 and look-up table memory 32 together with the seat levelling motor M and carriage drive motor M1. A transducer T provides the microprocessor with a signal from which it is able to determine the linear position of the carriage 10 along the rail 14 and a transducer $T_f$ provides the microprocessor with the feedback signal representing the actual angle of the seat relative to the carriage. The user's command signal is applied at C, to drive the carriage either up or down the rail. For preprogramming the memory, a control panel 40 is plugged into the control system, as shown, and used to move the carriage to successive positions along the rail, the seat being manually levelled at each point and then the corresponding linear carriage position and seat-to-carriage angle being stored in the memory. The carriage movement from one point to the next may be produced via the usual control push-button of the stairlift, or using corresponding keys on the preprogramming control panel 40, as indicated by the dotted line. At each point, a key on the control panel 40 is actuated to provide a signal to the microprocessor over an input B, to turn the seat to a level position. Then an "enter" key on the control panel is actuated to provide a signal to the microprocessor, over input A, causing the microprocessor to store the corresponding linear position and seat-to-carriage angle in its memory.

Alternatively or in addition, the stairlift may include an auto-calibration facility. In this case, the seat is fitted with a level transducer, for example a pendulum coupled to a potentiometer, which gives an output signal according to any inclination of the seat from its level position. The stairlift can be set to an auto-calibration mode, in which its drive motor is energised to drive it from one end of the rail to the other: at successive points along the rail, the carriage stops and the seat levels itself via its levelling motor; when the level transducer indicates that the seat is level, the microprocessor stores the corresponding linear position and seat-to-carriage angle in its memory.

Referring again to FIG. 1 of the drawings, the stairlift may include a safety arrangement comprising a locking pin 52 which is spring-loaded to extend through a locating aperture 53 in its support 23, thus locking the seat relative to its carriage 10. The seat is provided with a pair of mercury tilt switches 54,55 which normally close a circuit to a solenoid to hold the pin 52 retracted out of the aperture 53: if the seat tilts to a predetermined angle in one sense or the other, pin 52 is extended through the locating aperture 53 by its spring. The safety arrangement therefore prevents the seat from tilting to any angle, greater than that predetermined angle, relative to the carriage: preferably at the same time as locking the seat, the safety arrangement disables the stairlift. The arrangement thus protects against any failure of the automatic levelling system.

I claim:

1. A stairlift comprising a carriage for movement along a fixed rail, a seat pivotally mounted to the carriage, an electric motor for turning the seat relative to its carriage, an electronic memory programmed with data representing the desired angle between the seat and the carriage at different positions of the carriage along the rail and electronic control means responsive to the position of the carriage along its rail and to the data stored in the electronic memory, to control the electric motor so as to maintain the seat substantially level.

2. A stairlift as claimed in claim 1, comprising a closed-loop servo control system in which said electric motor is included.

3. A stairlift as claimed in claim 1, in which said electronic control means is arranged to determine the position of the carriage along its rail from a count related to the turns made by a drive motor of the carriage.

4. A stairlift as claimed in claim 1, in which said electronic control means is arranged to make linear interpolations between successive items of the stored data to provide an uninterrupted demand signal to said electric motor.

5. A stairlift as claimed in claim 1, comprising means responsive to the seat tilting, relative to the carriage, to more than a predetermined angle, to lock the seat to the carriage.

6. A stairlift as claimed in claim 1, further comprising a controller for preprogramming the electronic control means with said data representing the desired seat-to-carriage angle at different positions of the carriage along its rail.

7. A stairlift as claimed in claim 6, in which the control means comprises means to self-level the seat at successive points along the rail and then to write the corresponding carriage position data and seat-to-carriage angle data into said electronic memory.

* * * * *